US007244072B2

(12) United States Patent
Hawver et al.

(10) Patent No.: US 7,244,072 B2
(45) Date of Patent: Jul. 17, 2007

(54) SHEET RECORDING APPARATUS WITH DUAL NIP TRANSPORT

(75) Inventors: Jeffery R. Hawver, Marion, NY (US); Mark D. Bedzyk, Pittsford, NY (US); Scott C. Milton, Maplewood, MN (US)

(73) Assignee: Eastman Kodak Company, Rochester, NY (US)

( * ) Notice: Subject to any disclaimer, the term of this patent is extended or adjusted under 35 U.S.C. 154(b) by 251 days.

(21) Appl. No.: 10/977,841

(22) Filed: Oct. 29, 2004

(65) Prior Publication Data

US 2006/0104702 A1 May 18, 2006

(51) Int. Cl.
*B41J 11/58* (2006.01)
*B41J 13/10* (2006.01)

(52) U.S. Cl. ..... 400/625; 400/624; 400/636; 347/104

(58) Field of Classification Search ..... 347/104; 400/625, 624

See application file for complete search history.

(56) References Cited

U.S. PATENT DOCUMENTS

| | | | | |
|---|---|---|---|---|
| 4,565,130 | A * | 1/1986 | Leu | 101/240 |
| 5,209,589 | A | 5/1993 | Bliss | |
| 5,392,837 | A | 2/1995 | Yukumoto et al. | |
| 5,520,383 | A | 5/1996 | Amagai et al. | |
| 6,007,063 | A | 12/1999 | Park | |
| 6,027,211 | A * | 2/2000 | Unosawa et al. | 347/104 |
| 6,135,025 | A | 10/2000 | Zimmer | |
| 6,262,756 | B1 * | 7/2001 | Kashino et al. | 347/215 |
| 2002/0076251 | A1 | 6/2002 | Hsu et al. | |
| 2003/0103125 | A1 | 6/2003 | Endo | |
| 2006/0139420 | A1 * | 6/2006 | Muranaka et al. | 347/86 |
| 2006/0164491 | A1 * | 7/2006 | Sakuma et al. | 347/104 |

FOREIGN PATENT DOCUMENTS

| | | |
|---|---|---|
| EP | 1 089 547 | 4/2001 |
| JP | 63-230455 | 9/1988 |
| JP | 02-010966 | 1/1990 |
| JP | 04-317948 | 11/1992 |
| JP | 06-199444 | 7/1994 |
| WO | WO 03/086921 | 10/2003 |

OTHER PUBLICATIONS

Derwnt 2003-579505.*

* cited by examiner

*Primary Examiner*—Daniel J. Colilla
*Assistant Examiner*—Marissa Ferguson-Samreth
(74) *Attorney, Agent, or Firm*—Nelson Adrian Blish

(57) ABSTRACT

An apparatus for recording an image onto a sheet medium (12) has an entrance nip (14) for transporting the sheet medium (12) into an image recording section (20). A write head (56) records onto a portion of the sheet medium (12) between the entrance nip (14) and exit nip (24). The exit nip (24) is formed by a drive roller (26) paired with a corresponding exit pressure roller (28). A motor (60) provides rotary motion to either the entrance drive roller (16) or the exit drive roller (26). A coupling apparatus (54) has a coupling roller (36) and a loading mechanism providing a loading force to nest the coupling roller (36) into continuous rotational contact against the entrance and exit drive rollers (16,26), whereby rotation is transferred between the exit drive roller (26) and the entrance drive roller (16).

54 Claims, 20 Drawing Sheets

SHEET RECORDING APPARATUS WITH DUAL NIP TRANSPORT

FIELD OF THE INVENTION

This invention generally relates to sheet media transport apparatus and more particularly relates to an image recording apparatus with a precision media transport apparatus that uses a dual nip system having precision drive roller motion coupled by a coupling roller.

BACKGROUND OF THE INVENTION

Nip-fed sheet media transport systems using paired rollers are widely used in various printing applications. In a nip-fed system, a drive roller is pressed against a backing roller to form a nip and provides drive motion at the nip. A nip-fed transport can be engineered to perform with a suitable degree of accuracy in devices such as printers and office copiers. However, conventional nip-fed media transport mechanisms do not provide sufficient precision for imaging applications that require high resolution. For example, many types of medical imaging apparatus print onto a sheet of recording medium at resolutions well exceeding 600 dots per inch. For such devices, a sheet media transport must provide extremely accurate motion when moving the sheet through the image recording mechanism. This problem becomes even more pronounced with full-sheet imaging, in which little or no margin is to be provided at the leading or trailing edges of a sheet. As is well appreciated by those skilled in media transport arts, the dynamics of handling and urging a sheet of recording medium through a printing mechanism can be much more complex at the leading and trailing edges that along more central portions of the sheet.

Dual nip apparatus provide advantages where it is necessary to provide more precise motion control for sheet media. By using two pairs of rollers in series along the transport path, a more stable sheet media transport is provided, since the motion of the medium is controlled through at least one nip at any point during the image recording process. FIG. 1 shows, in schematic form, a conventional dual nip transport apparatus 10 as used for a sheet of recording medium 12. In the travel path, medium 12 is fed through an entrance nip 14 formed between an entrance drive roller 16 and a pressure roller 18, then through an exit nip 24 formed between an exit drive roller 26 and a pressure roller 28. Image data is recorded by a printhead 56 onto medium 12 in an imaging area 20 between entrance nip 14 and exit nip 24, typically using a laser or other source of electromagnetic radiation. In order to provide uniform speed with dual nip media transport apparatus 10, it is necessary to couple the speed of entrance drive roller 16 at entrance nip 14 with the speed of exit drive roller 26 at exit nip 24. The conventional method for coupling entrance and exit drive rollers 16 and 26 is using a belt 22, as shown in FIG. 1.

While the use of belt 22 for synchronizing entrance and exit drive rollers 16 and 26 works well in many applications, the precision afforded by this arrangement falls short of what is needed for high resolution imaging. Problems such as disturbance of uniform velocity or flutter cause variation in the transport velocity of medium 12, particularly during leading-edge and trailing-edge handling intervals in which medium 12 is gripped only at entrance nip 14 or exit nip 24. Other problems related to compliance and tracking render the use of belt 22 as an unsatisfactory solution, particularly for media such as film that is generally thicker and more rigid than paper media or for sheet media that can vary in thickness. Furthermore, belt 22 is a wear item that may require replacement and whose performance can be degraded by age, usage, and dust or dirt.

Thus, it can be seen that there is a need for a transport mechanism that provides precision handling of single sheet media at a constant transport speed, allowing full sheet imaging from leading to trailing edge.

SUMMARY OF THE INVENTION

It is an object of the present invention to provide a sheet media transport apparatus capable of improved precision. With this object in mind, the present invention provides an apparatus for recording an image onto a sheet medium, comprising:

a) an entrance drive roller paired with a corresponding entrance pressure roller to form an entrance nip for transporting the sheet medium into an image recording section;

b) the image recording section comprising a write head for recording onto a portion of the sheet medium being transported between the entrance nip and an exit nip;

c) the exit nip formed by a drive roller paired with a corresponding exit pressure roller, for transporting the sheet medium out from the image recording section;

d) a motor for providing rotary motion;

e) a coupling apparatus for coupling rotary motion between the exit drive roller and the entrance drive roller, the coupling apparatus comprising:

i) a coupling roller elongated in the width dimension of the sheet medium;

ii) a loading mechanism providing a loading force to nest the coupling roller into continuous rotational contact against the entrance and exit drive rollers; and whereby rotation is transferred between the exit drive roller and the entrance drive roller by the coupling roller.

It is a feature of the present invention that it employs a coupling roller to transfer rotational energy between driver rollers. Unlike prior art arrangements, the coupling roller does not form a nip or directly transport the medium, but is used to provide continuous, smooth motion between the entrance and exit drive rollers, each of which forms its corresponding nip with a separate pressure roller.

It is an advantage of the present invention that it provides a sheet media transport solution with higher mechanical coupling stiffness than is conventionally available using belt devices. This increased coupling stiffness, in turn, improves mechanical resonance characteristics of the media transport apparatus of the present invention. The apparatus and method of the present invention minimize the need for replaceable components and provide a self-aligning coupling, minimizing the need for synchronization adjustment to the sheet transport apparatus.

It is an advantage of the present invention that it provides improved velocity uniformity, with a design that inherently averages surface noise from system components. In one embodiment, the apparatus of the present invention eliminates the need for external bearings, thereby reducing cost and improving overall reliability.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

The present description is directed in particular to elements forming part of, or cooperating more directly with, apparatus in accordance with the invention. It is to be understood that elements not specifically shown or described may take various forms well known to those skilled in the art.

Figure 2:
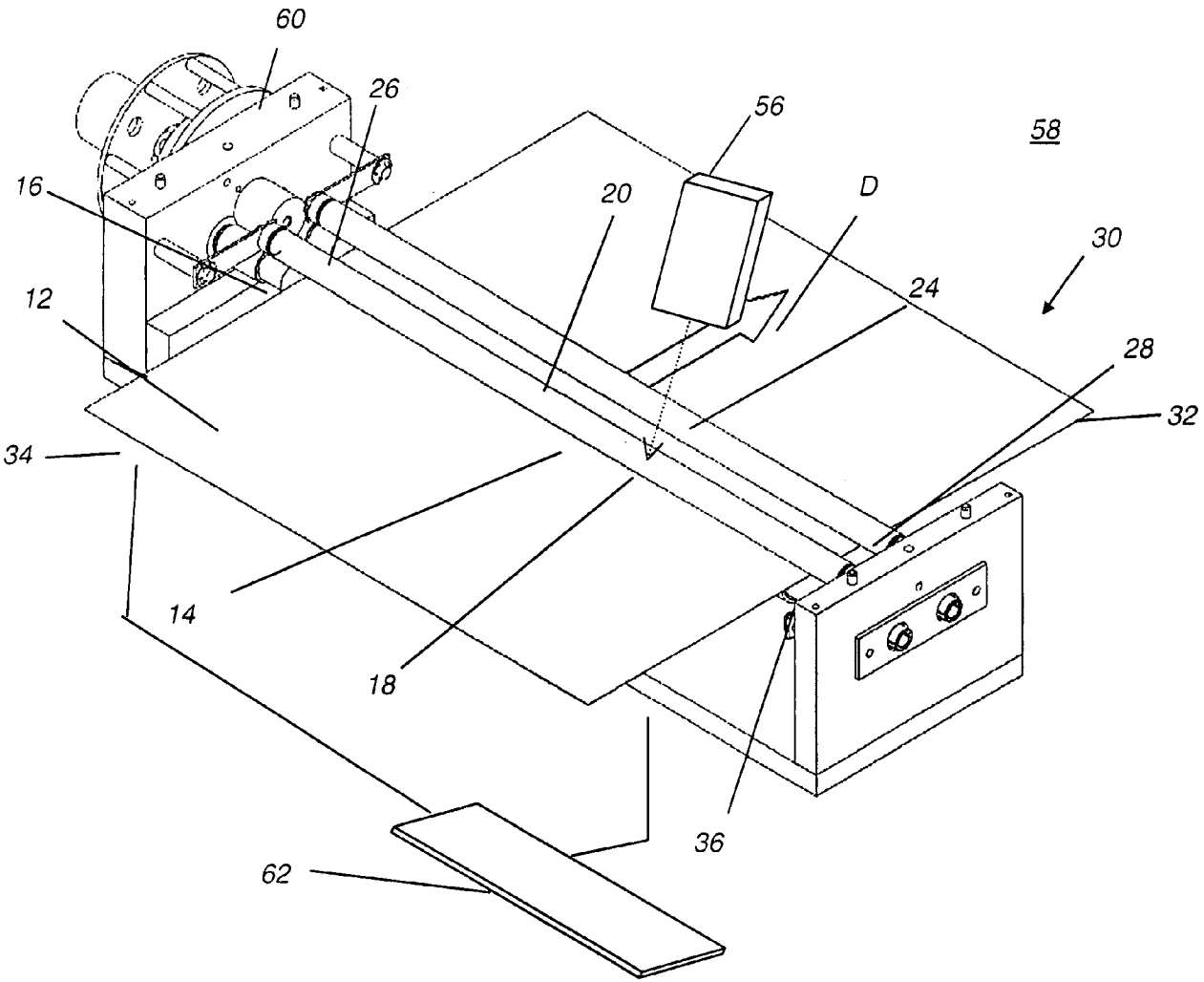
FIG. 2 is a perspective view of an apparatus for image recording, using a dual-nip media transport according to the present invention.

Referring to FIG. 2, there is shown an image recording apparatus 58 for full sheet imaging, utilizing a dual nip media transport apparatus 30 according to an embodiment of the present invention. A sheet of recording medium 12, transported in direction D, has a leading edge 32 and a trailing edge 34. Pressure rollers 18 and 28 cooperate with corresponding entrance and exit drive rollers 16 and 26 to form entrance nip 14 and exit nip 24, respectively. In the embodiment shown, a motor 60 provides rotational energy to exit drive roller 26. This rotation is coupled to entrance drive roller 16 by a coupling roller 36, only partially visible in FIG. 2, but shown in more detail in subsequent figures. Imaging area 20 is in a widthwise strip of recording medium 12 between entrance and exit nips 14 and 24. Printhead 56 directs exposure energy from a laser or other source, in a scanned fashion, onto that portion of recording medium 12 that is within imaging area 20. A control logic processor 62 controls the flow of image data to printhead 56, operation of motor 60, which may be provided with an encoder, and other internal and interface functions of image recording apparatus, using components, algorithms, and techniques familiar to those skilled in the electronic imaging arts.

Figure 3A:
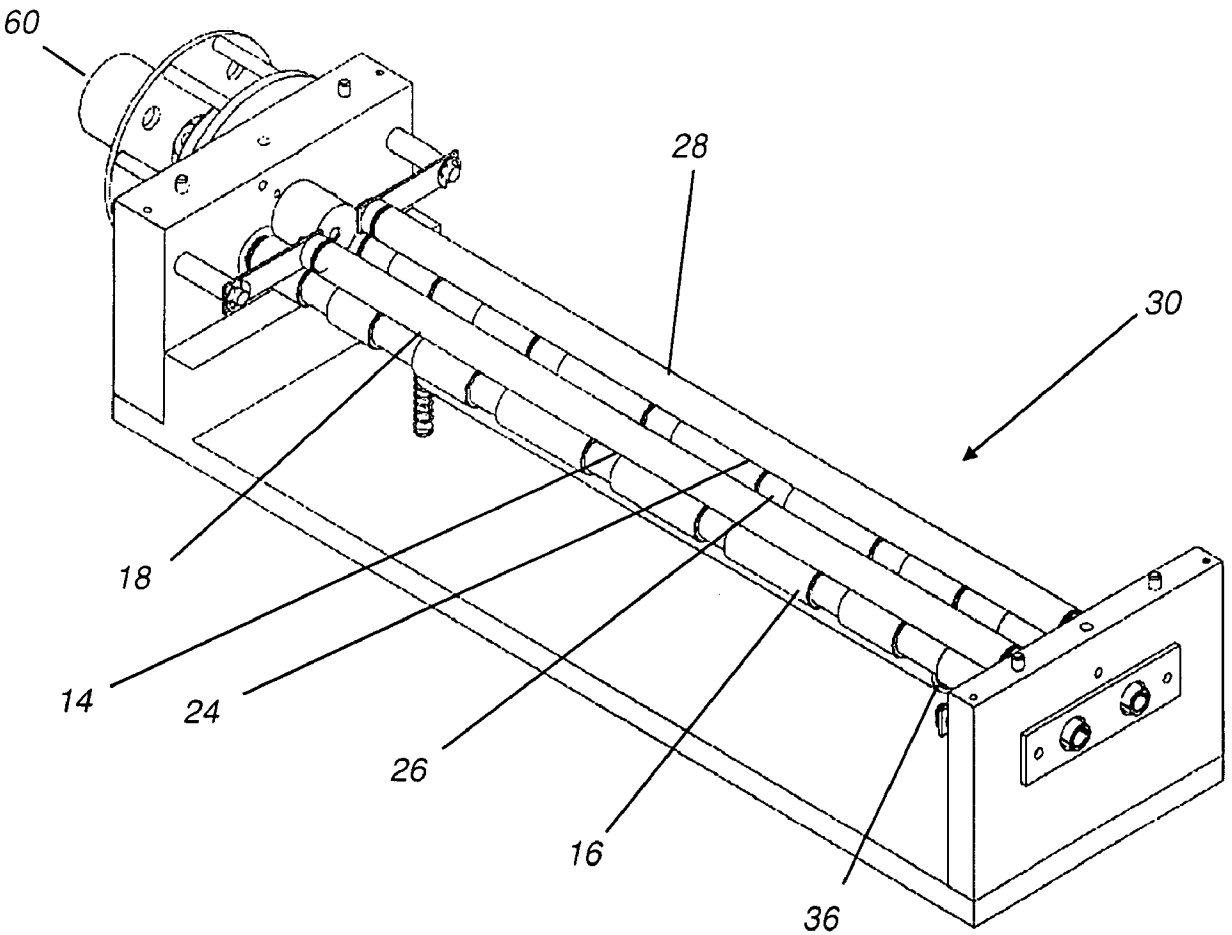
FIG. 3A is a perspective view showing a dual-nip media transport apparatus of the present invention.
Figure 3B:
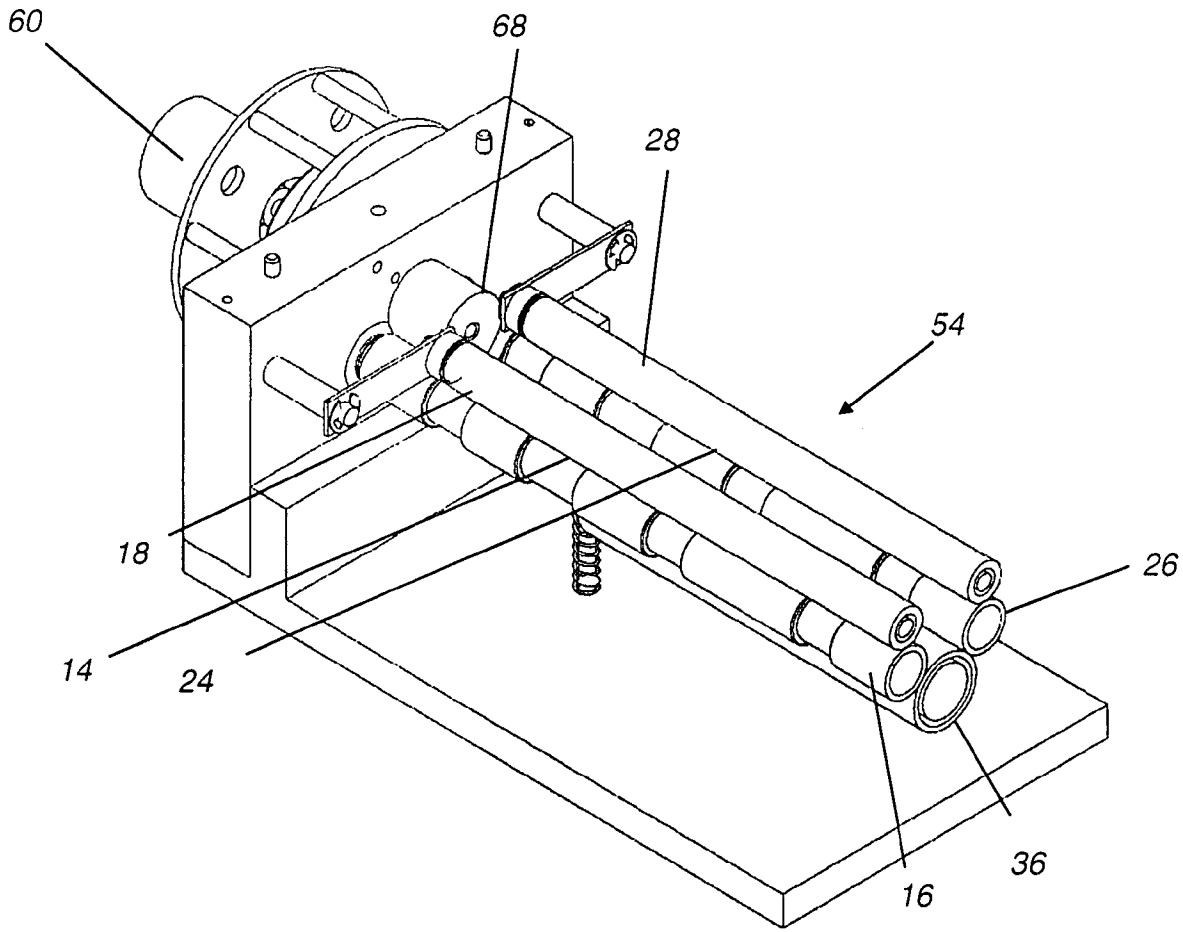
FIG. 3B is a cutaway perspective view showing a dual-nip media transport apparatus of the present invention.

Referring to FIG. 3A, the arrangement of various structures is shown more clearly, without recording medium 12. In FIG. 3B, there is shown a cutaway view of dual nip transport apparatus 30 in one embodiment. Coupling roller 36 extends over most of the length of drive rollers 16 and 26 in this embodiment. A loading force, applied as described subsequently, nests coupling roller 36 against drive rollers 16 and 26, thereby maintaining continuous rolling contact with drive rollers 16 and 26. This arrangement helps to smooth out mechanical irregularities or "noise" and to provide equal transport velocity through entrance and exit nips 14 and 24.

Figure 4A:
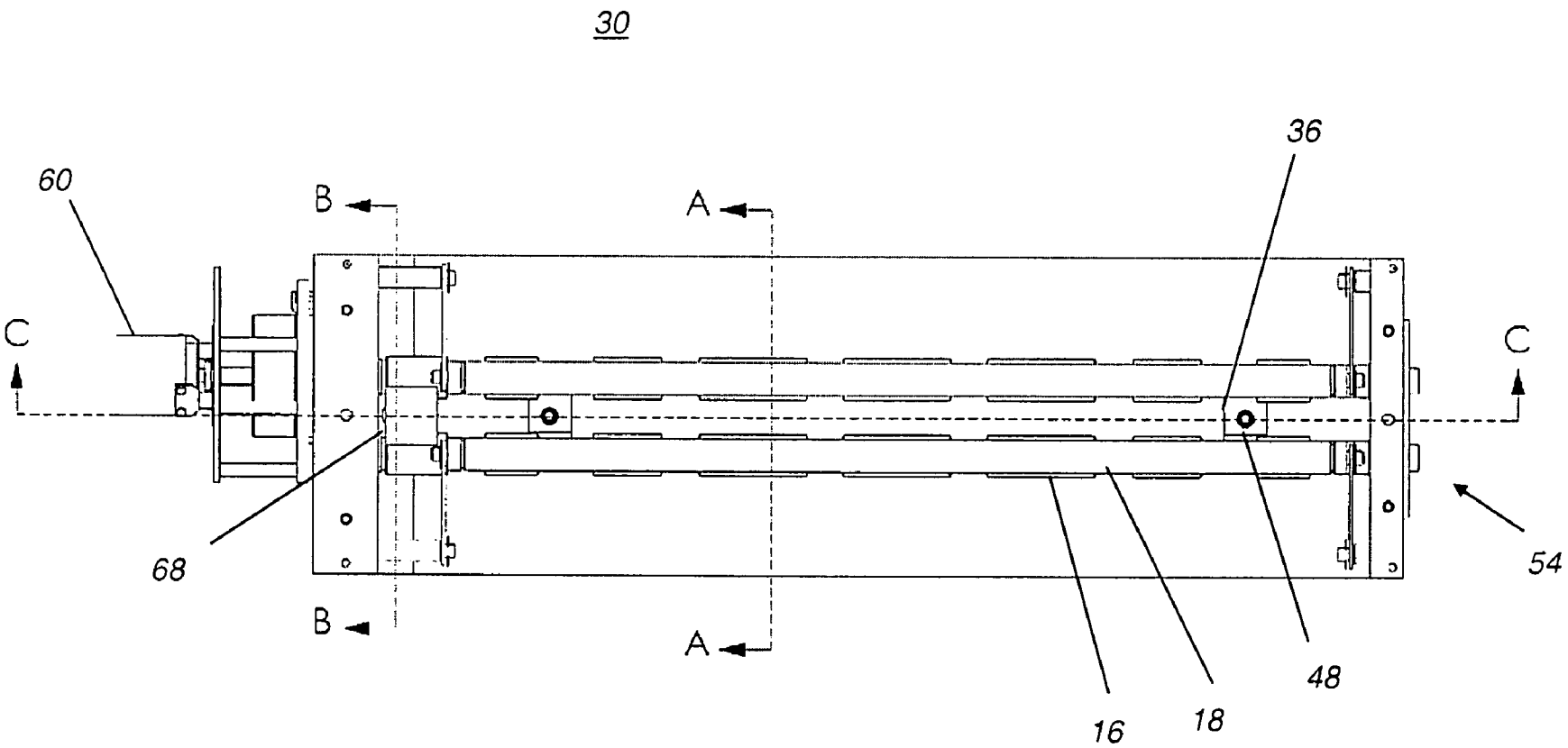
FIG. 4A is a top view of the dual nip media transport.
Figure 4B:
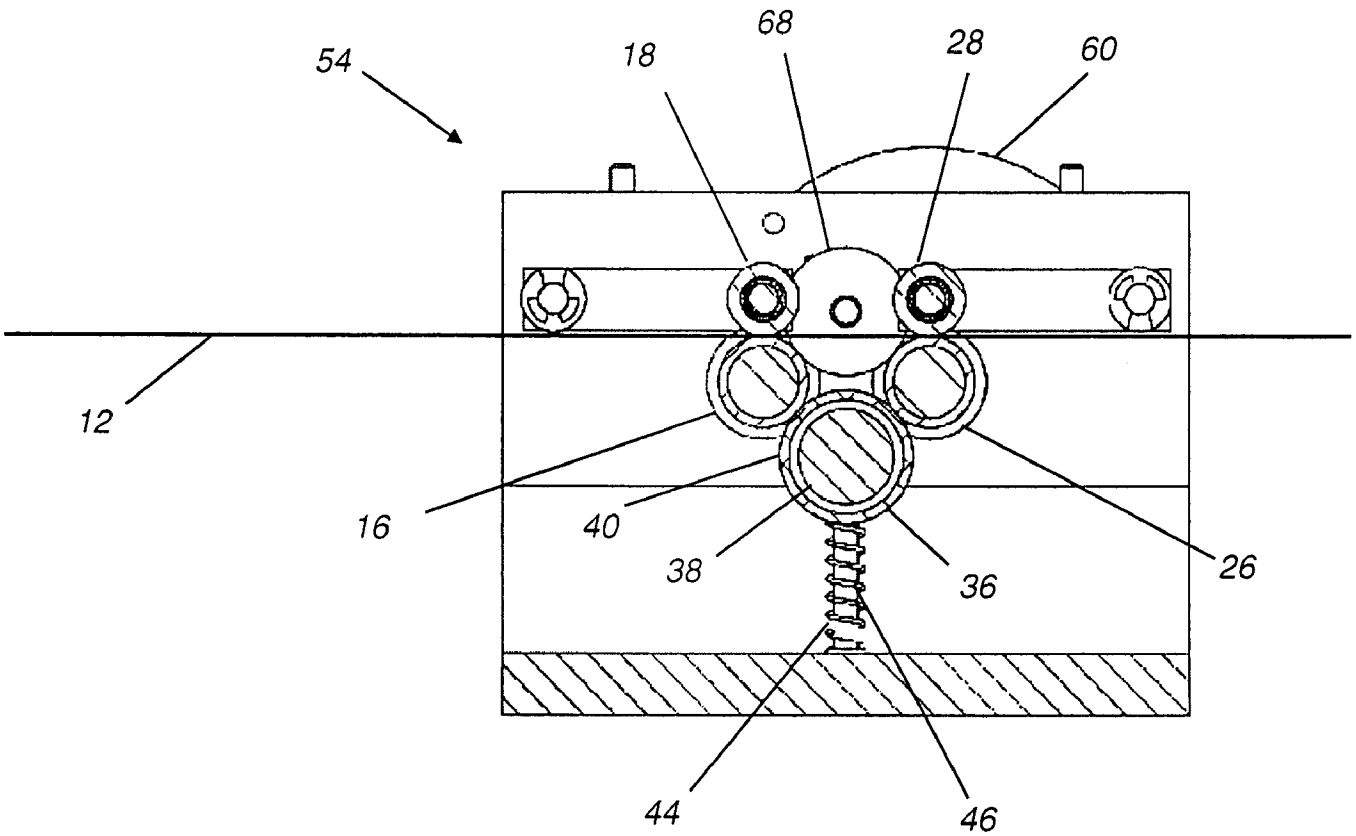
FIG. 4B is a widthwise cross-sectional side view of the media transport of FIG. 4A.

Referring to FIG. 4A, there is shown a top view of dual nip transport apparatus 30, with coupling apparatus 54 components indicated in one embodiment. The cross-sectional views of FIGS. 4B, 4C, and 4D, sectioned along lines A-A, B-B, and C-C respectively, show different views of this embodiment, in which springs 46 apply the loading force needed to nest coupling roller 36 against entrance and exit drive rollers 16 and 26. Here, coupling roller 36 has a stationary internal core 38 and an outer rotatable shell 40, with bearings 42 fitted between core 38 and shell 40 at opposite ends of coupling roller 36. A spring mount 44 houses a spring 46 that provides an upward spring force against a shaft 48 and core 38 to press coupling roller 36 continuously in place against drive rollers 16 and 26. Referring back to FIG. 3B, it can be observed that this arrangement, with coupling roller 36 forced against drive rollers 16 and 26, allows coupling roller 36 to be self-aligning, so that it nests snugly against both drive rollers 16 and 26 throughout its rotation.

Embodiment Using Magnetic Attraction

Figure 4C:
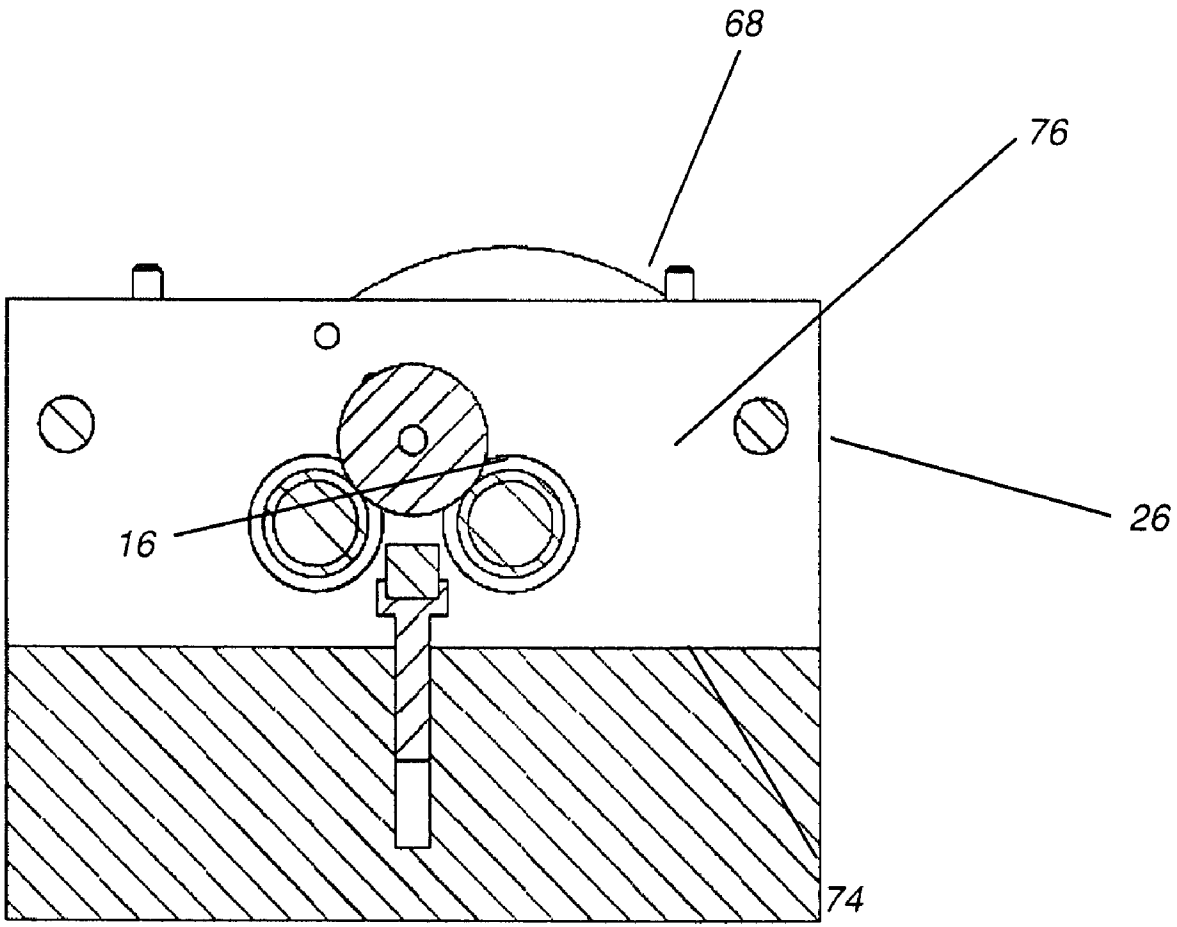
FIG. 4C is another widthwise cross-sectional side view of the media transport of FIG. 4A.
Figure 4D:
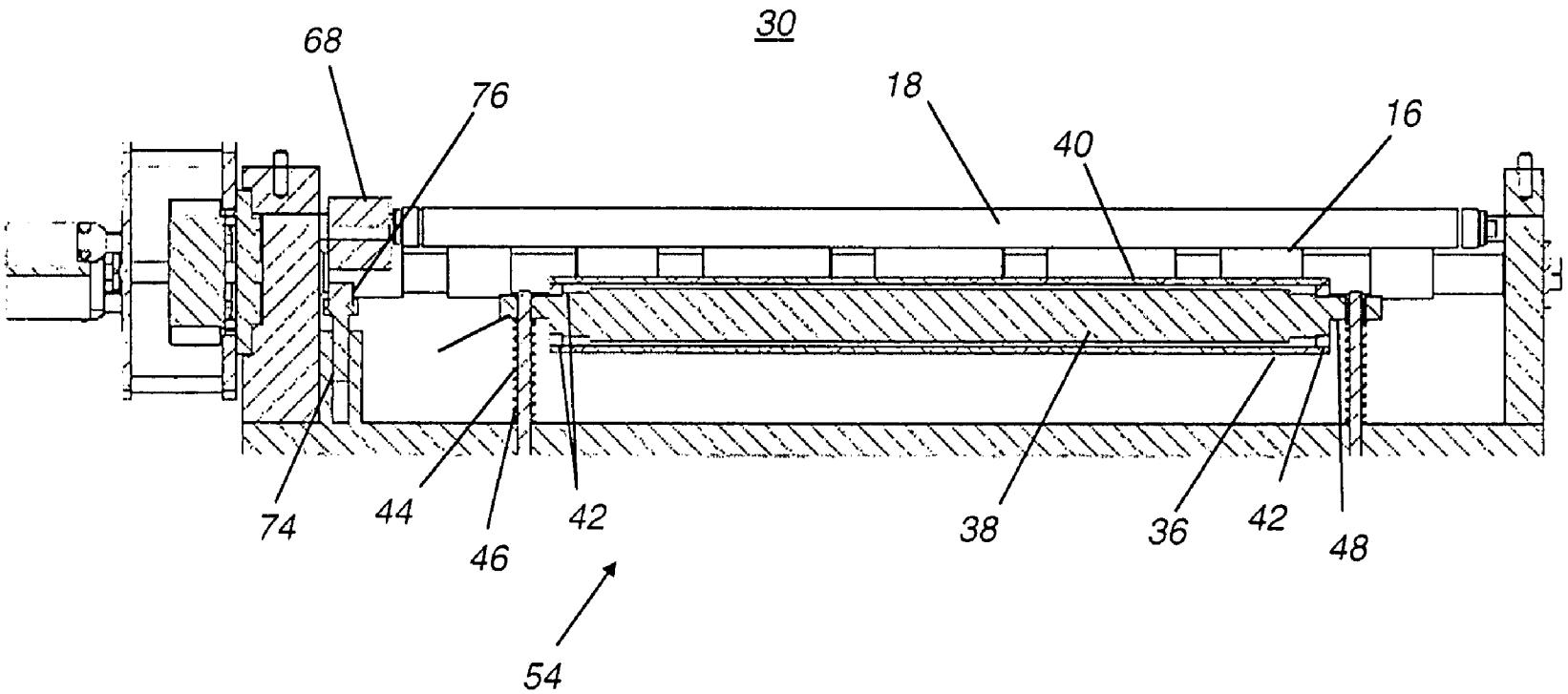
FIG. 4D is a lengthwise cross-sectional view of the media transport of FIG. 4A.
Figure 5A:
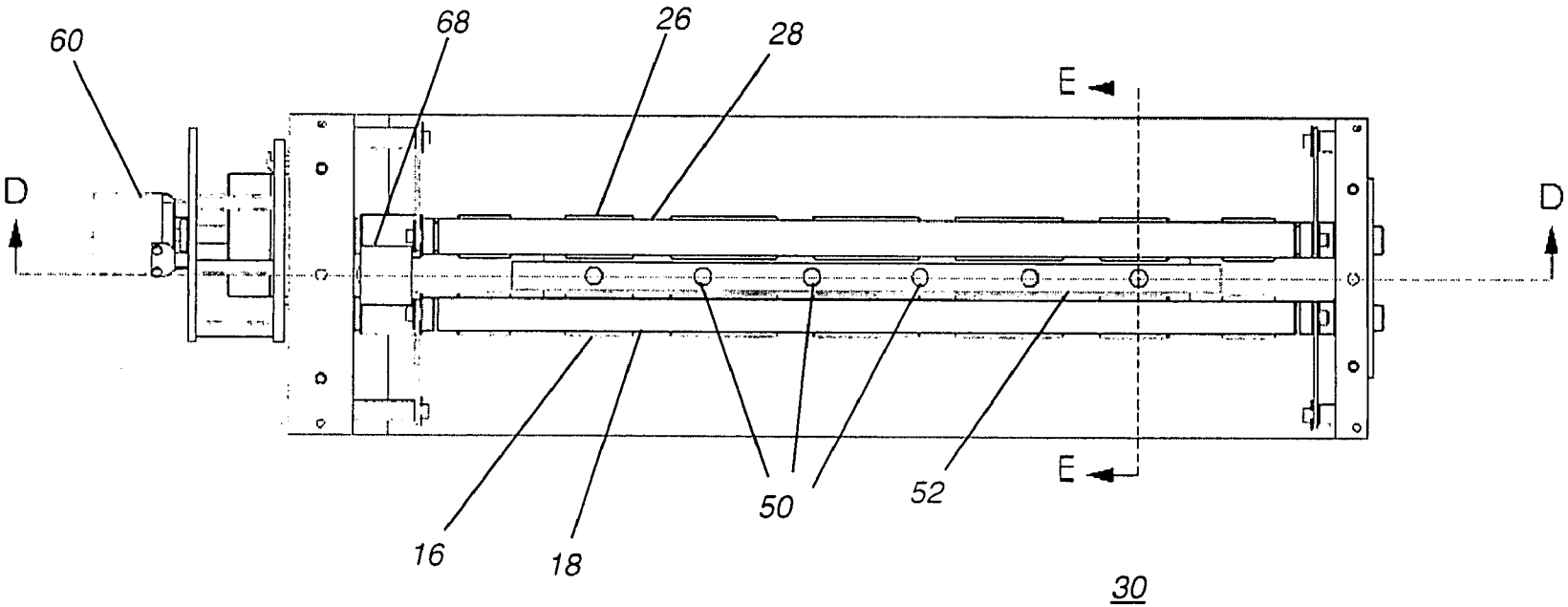
FIG. 5A is a top view of a dual nip media transport in an alternate embodiment.
Figure 5B:
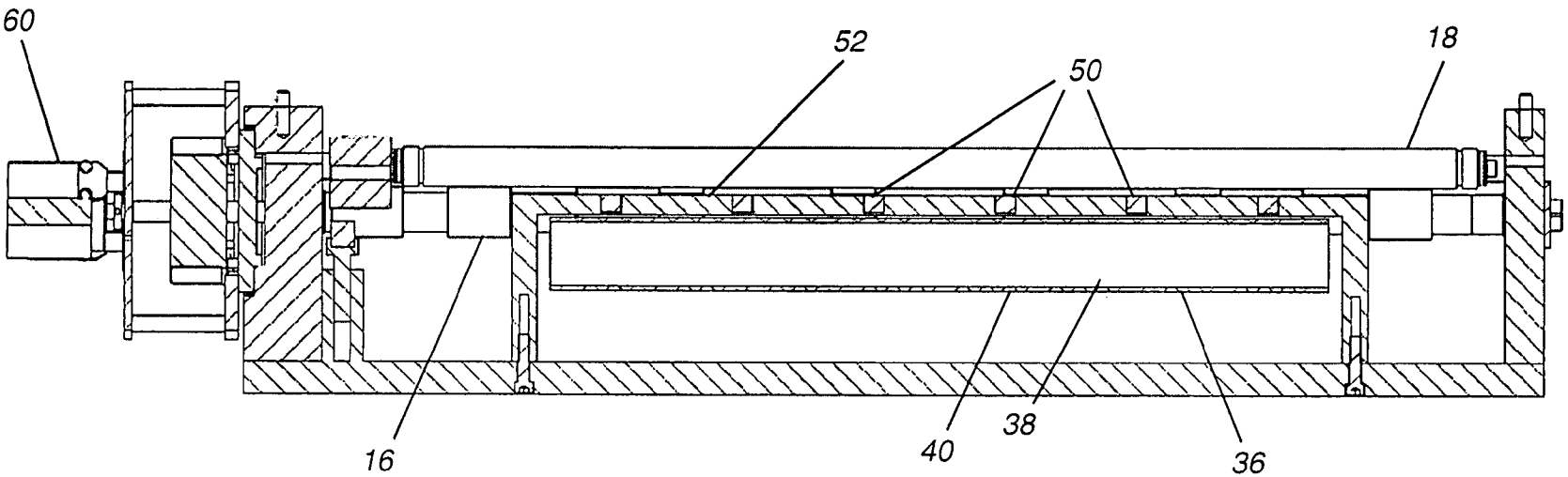
FIG. 5B is a lengthwise cross-sectional view of the media transport of FIG. 5A.
Figure 5C:
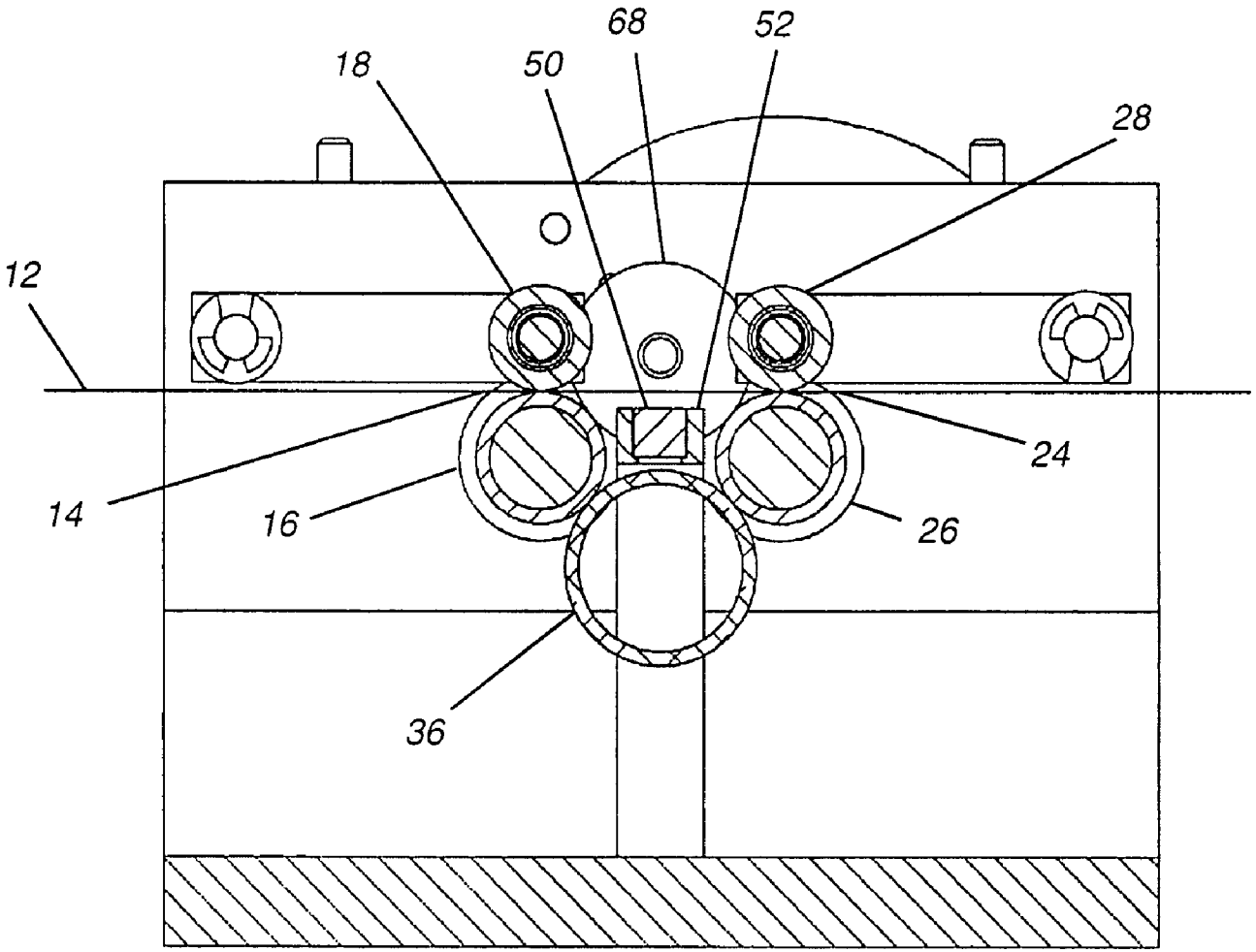
FIG. 5C is a widthwise cross-sectional side view of the media transport of FIG. 5A.
Figure 6:
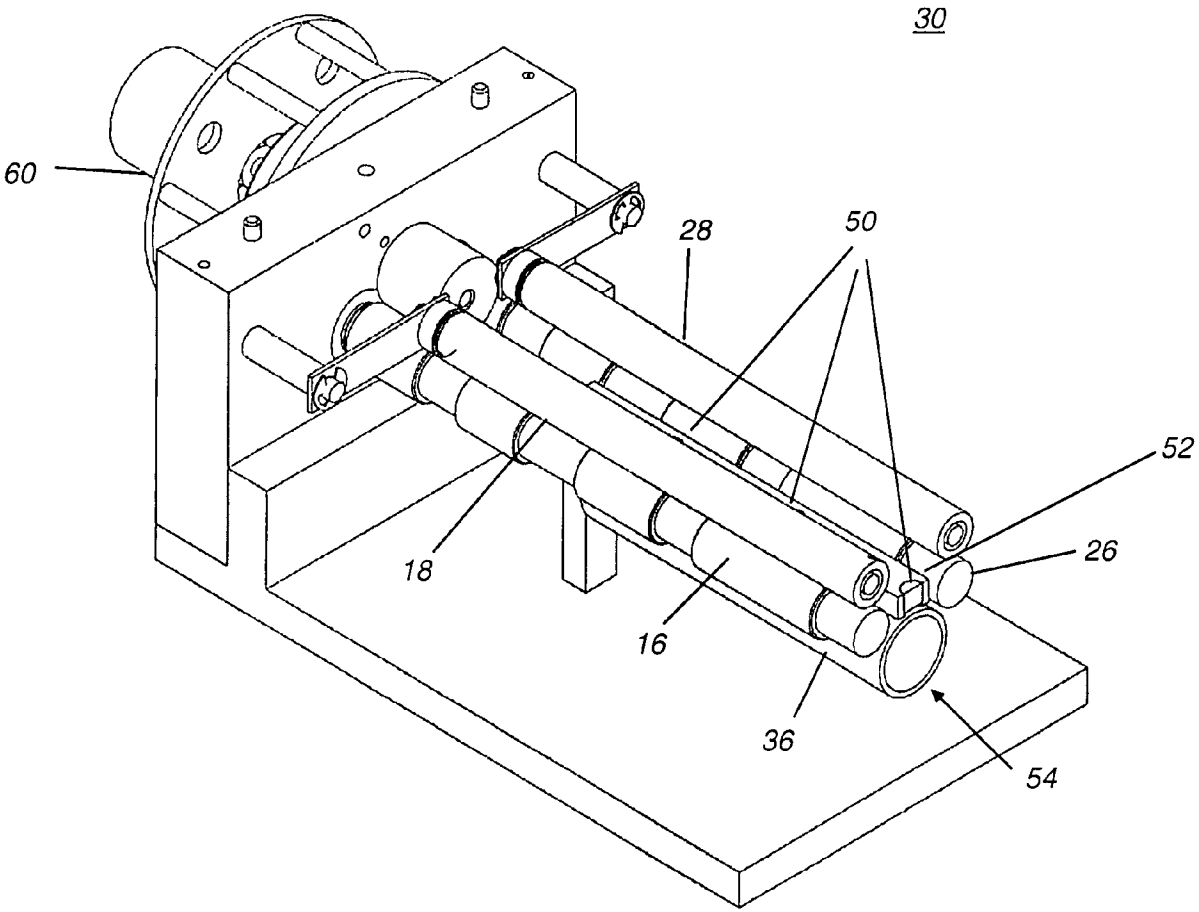
FIG. 6 is a cutaway perspective view showing a dual nip media transport in an alternate embodiment.

Referring to the top view of FIG. 5A, widthwise and lengthwise sectional views of FIGS. 5B and 5C, and cutaway perspective view of FIG. 6, there is shown an alternate embodiment in which coupling roller 36 is held in place by magnetic force. Magnetic force can be applied in any of a number of ways. In the embodiment of FIG. 5A through FIG. 6, one or more stationary magnets 50 is installed along or within an intermediate bar 52 to attract coupling roller 36 up against drive rollers 16 and 26. Alternately, coupling roller 36 could itself be magnetized and attracted toward bar 52, where bar 52 is made of a ferromagnetic material, to produce the same effect. Magnets 50 could be replaceable magnets, for example. Possible types of magnet 50 include Alnico, Samarium cobalt, Neodymium Iron Boron, or ceramic, for example. The arrangement of FIG. 5A through FIG. 6 is advantaged over the arrangement of FIGS. 4A-4D in a number of ways. Since magnetic attraction is used in this embodiment, assembly and disassembly of coupling apparatus 54 can easily be done manually, without any tools or fasteners. Coupling roller 36 is preferably hollow in this type of embodiment, to reduce inertia. Coupling roller 36, magnetically attracted to bar 52, is self-aligning, requiring no adjustment other than generally centering coupling roller 36 along the length of drive rollers 16 and 26. No additional bearings or replaceable parts are required, since drive rollers 16 and 26 effectively provide bearing surfaces for coupling roller 36. Although not shown in FIG. 5A through FIG. 6, stop mechanisms would be needed to constrain longitudinal movement of a magnetically held coupling roller 36, that is, to stop unwanted movement parallel to its axis of rotation.

In another embodiment, magnets 50 are replaced by electromagnets. This arrangement would allow printer control logic (from control logic processor 62 in FIG. 2) to actuate coupling apparatus 54 when needed.

Preferred Direction of Rotation

FIG. 6 shows one arrangement of motor 60 for driving either entrance drive roller 16 or exit drive roller 26. Depending on the composition of drive rollers 16 and 26 and their corresponding pressure rollers 18 and 28, and on properties of recording medium 12 such as thickness and stiffness, it may be desirable for motor 60 to drive either entrance or exit drive rollers 16 or 26. In general, it has been found that coupling roller 36, because it provides a type of traction drive, has a preferred rotational direction, based on whether entrance or exit drive roller 16 or 26 is driven by motor 60. In the preferred mechanical arrangement, at the optimal rotation direction, coupling roller 36 exhibits a tendency to be forced into the gap between entrance and exit drive rollers 16 and 26, in a phenomenon sometimes referred to as "wedging."

Figure 7A:
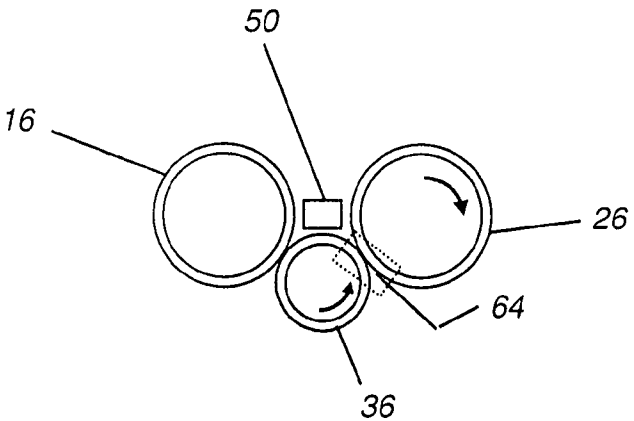
FIGS. 7A and 7B are cross-sectional schematic views showing the behavior of rollers in the dual nip media transport apparatus of the present invention, at different directions of rotation.

Referring to the cross-sectional view of FIG. 7A, this wedging tendency is shown for an embodiment using coupling roller 36. In this configuration, exit drive roller 26 is the driving roller, coupled to the shaft of motor 60. Clockwise rotation of exit drive roller 26 urges coupling roller 36 against a surface interface 64, represented by a dotted box in FIG. 7A and subsequent figures. This arrangement provides increased frictional force for driving entrance drive roller 16. The increase in frictional force is advantageous for improved mechanical coupling in this apparatus.

Figure 7B:
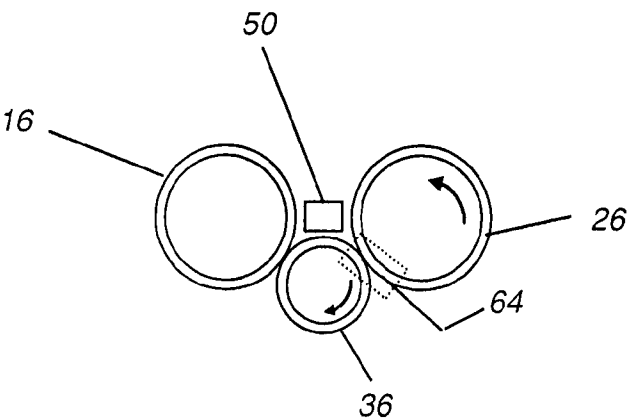

FIG. 7B shows an alternate arrangement wherein coupling roller 36 does not take advantage of wedging. Here, the same physical relationship applies for entrance drive roller 16, exit drive roller 26 and coupling roller 36; however, exit drive roller 26 is rotated in the counter-clockwise direction. This forces the surface of coupling roller 36 away from surface interface 64, providing decreased frictional force for driving entrance drive roller 16. Thus, it can be seen that, given the same arrangement of rollers 16, 26, and 36, different frictional effects are achieved, based on the rotation of the driving roller. There is, then, a preferred rotation direction for coupling roller 36 embodiments. Again, since either entrance drive roller 16 or exit drive roller 26 may be the driving roller in a particular embodiment, the same type of analysis described above is used to determine the most suitable direction of rotation in any specific case.

Providing Additional Coupling Stiffness

For many applications, it may be sufficient to determine and use the preferred rotation direction, achieving the best frictional conditions based on the wedging behavior described above. However, the inventors, somewhat in opposition to conventional practices, have discovered a further refinement to the use of coupling roller 36 whereby additional coupling stiffness and reduced flutter are achieved. Even though recording medium 12 is transported in a single direction, the inventors have found that providing coupling stiffness in both directions is advantageous. That is, there is quantifiable improvement of movement uniformity and reduction of flutter when coupling stiffness is provided in both forward and reverse directions.

Figure 8:
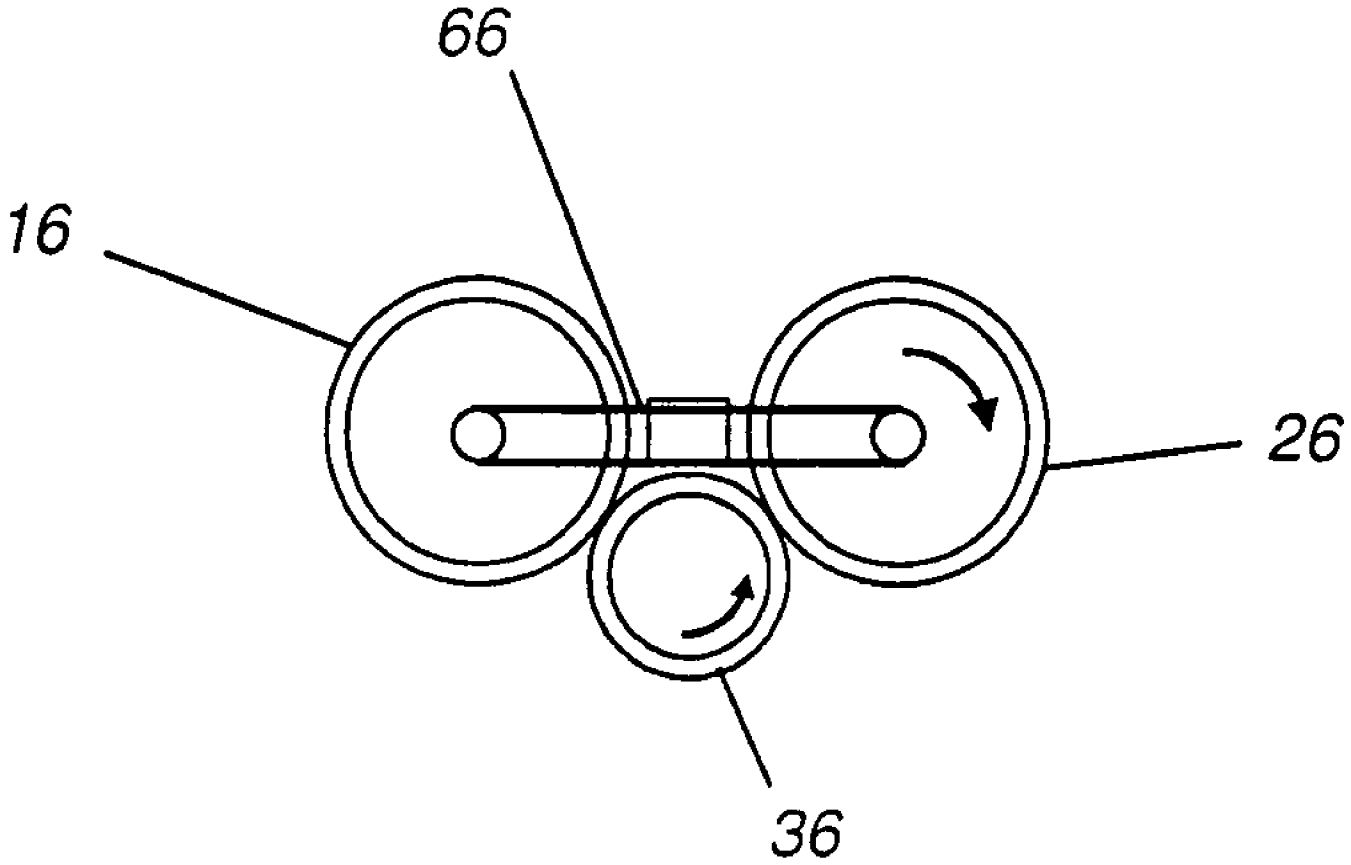
FIG. 8 is a cross-sectional schematic view showing an auxiliary belt supplementing the coupling roller arrangement of the present invention.

Referring to the cross-sectional view of FIG. 8, there is shown one refinement by which reverse coupling stiffness is achieved. Here, in addition to coupling roller 36, a belt 66 is provided to couple movement between entrance and exit rollers 16 and 26. The combination of coupling roller 36 and belt 66 provides coupling stiffness in both forward and reverse directions and improves the overall uniformity of movement velocity.

Figure 9A:
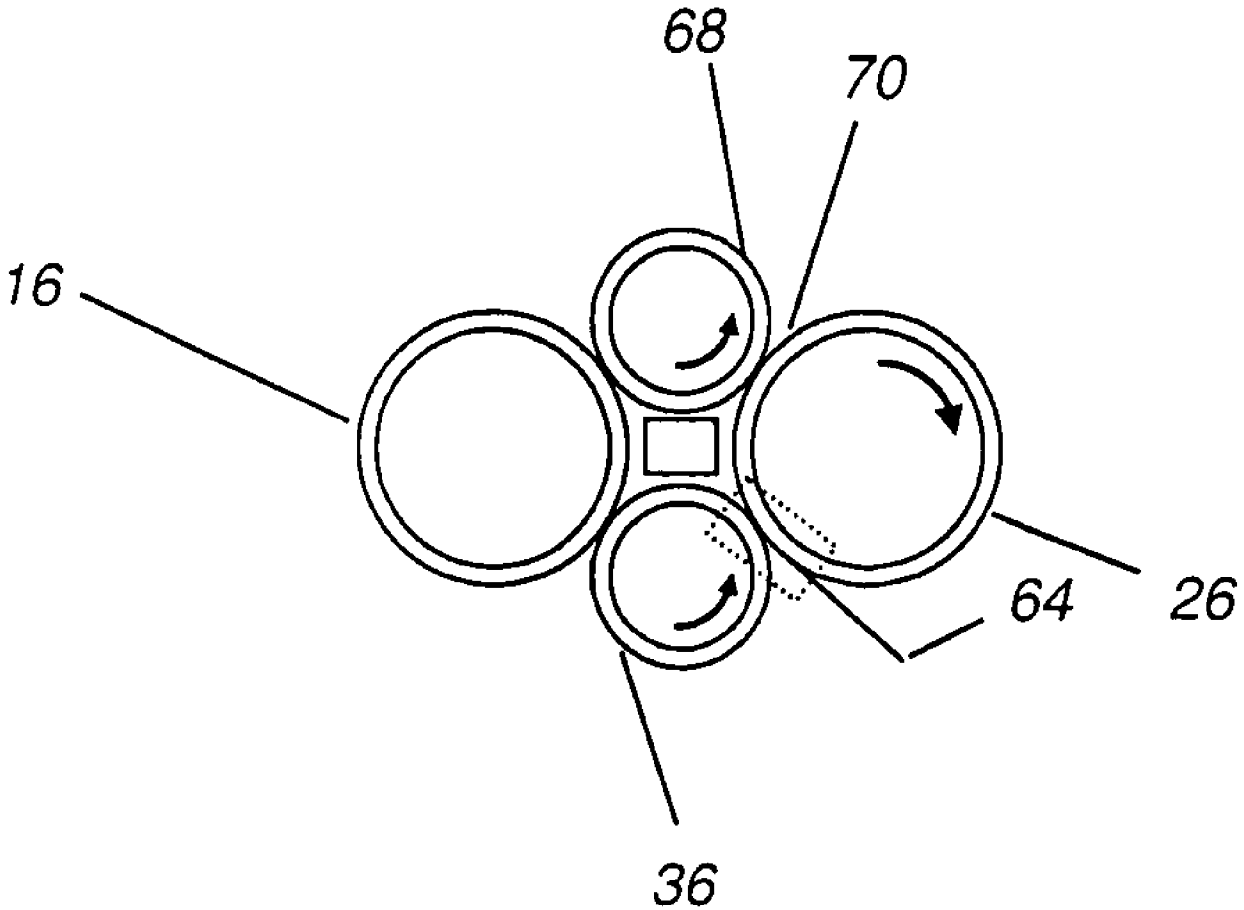
FIGS. 9A and 9B are cross-sectional schematic views showing the behavior of rollers in the dual nip media transport apparatus of an alternate embodiment of the present invention, at different directions of rotation.
Figure 9B:
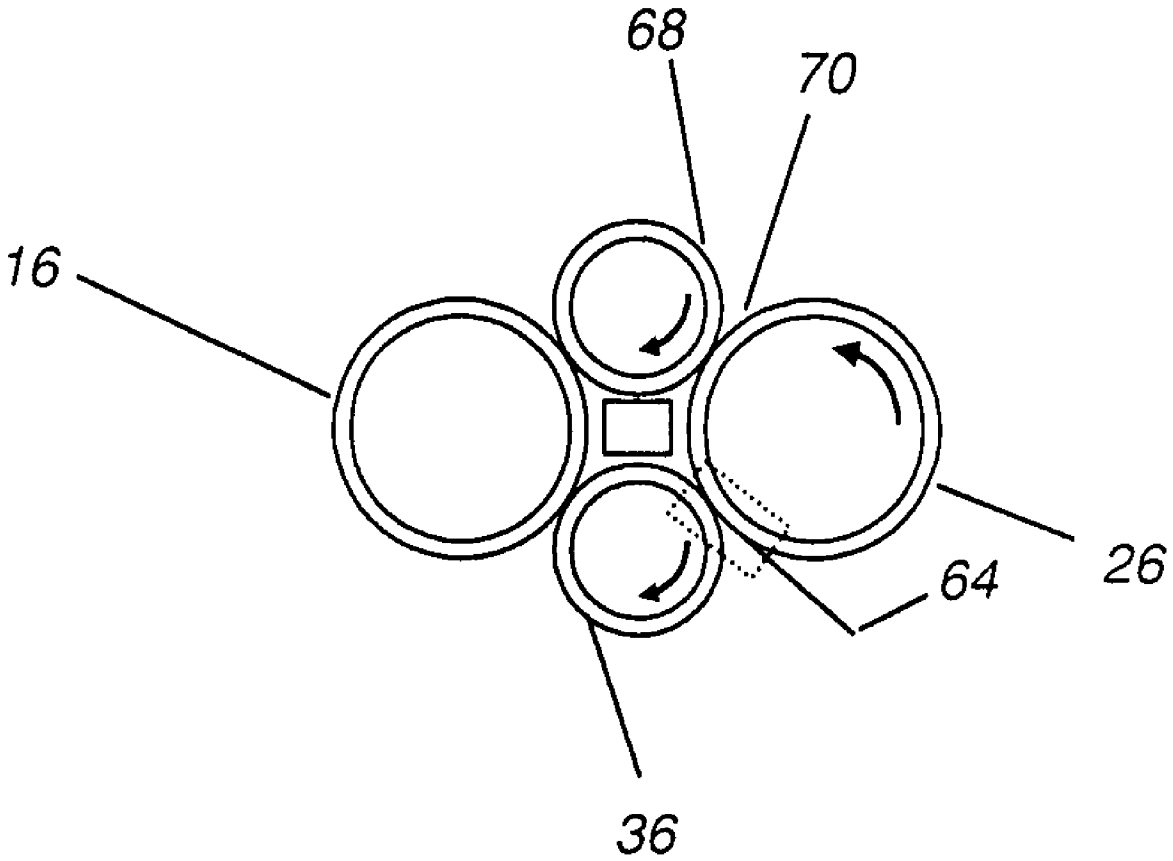

Another embodiment is shown in the cross sectional views of FIGS. 9A and 9B. Here, a counter roller 68 applies an opposing frictional force for movement in the forward direction, providing added coupling stiffness. Dimensionally, counter roller 68 extends over only a portion of the length of entrance and exit drive rollers 16 and 26, as is shown in the perspective cutaway view of FIG. 3B. This arrangement leaves imaging area 20, as was shown in FIG. 2, unobstructed. Counter roller 68 is nested in place against a portion of entrance and exit drive rollers 16 and 26, typically using magnetic attraction or by means of a spring or other force application mechanism. FIG. 4C shows an embodiment using magnetic attraction for counter roller 68. A magnet 76 on a post 74 attracts and thus nests counter roller 68 in position against entrance and exit drive rollers 16 and 26.

In FIGS. 9A and 9B, exit drive roller 26 is again the driving roller for recording medium 12 transport. FIG. 9A shows wedging behavior when exit drive roller 26 rotates in the clockwise direction. In FIG. 9A, coupling roller 36 is forced into surface interface 64. Counter roller 68 is forced out from a surface interface 70. In FIG. 9B, with exit drive roller 26 rotating in the counter-clockwise direction, the opposite wedging behavior is observed, with coupling roller 36 forced out from surface interface 64 and counter roller 68 forced into surface interface 70.

Flutter Reduction

In order to better understand how the apparatus and method of the present invention improve the performance of dual nip transport apparatus 30, it is useful to first describe flutter and its effects more precisely.

Any type of imaging method for photosensitive media provides exposure radiation to which the media responds in a controlled manner. As is well known, exposure energy is a factor of both the intensity of light radiation and the amount of time the radiation is applied, expressed in the familiar equation:

$$E=It \tag{1}$$

where I corresponds to the intensity, t corresponds to exposure duration and E the resulting exposure of the media.

In a raster line scan printer such as image recording apparatus 58 of FIG. 2, recording medium 12 is moved under a scanning light beam at printhead 56 to achieve a full area exposure. Since exposure is a function of the time recording medium 12 spends under the beam, movement of the recording medium 12 must be accurately controlled. This is typically accomplished using a precision media transport that provides very accurate and stable constant velocity. If there are any disturbances to the uniformity of the transport velocity, corresponding non-uniformities are manifest in the density resulting from the exposure.

Velocity disturbances are expressed as percent deviation from the nominal constant velocity. These velocity disturbance errors are typically called flutter velocity errors (FE) and defined as:

$$FE = \frac{\Delta V}{Vnom} \times 100\% \quad (2)$$

where FE is the flutter error, ΔV is the velocity error from nominal and Vnom is the set target velocity of the media. Since flutter is typically a time varying noise error, there are a number of ways it can be specified. Flutter can be expressed in terms of an RMS, peak, or peak to peak value. In addition, knowledge of the spectral components of the flutter error is also frequently desired. This can be obtained from time domain flutter signals that have been processed using FFT algorithms to produce a graph of flutter magnitude versus frequency.

Figure 10A:
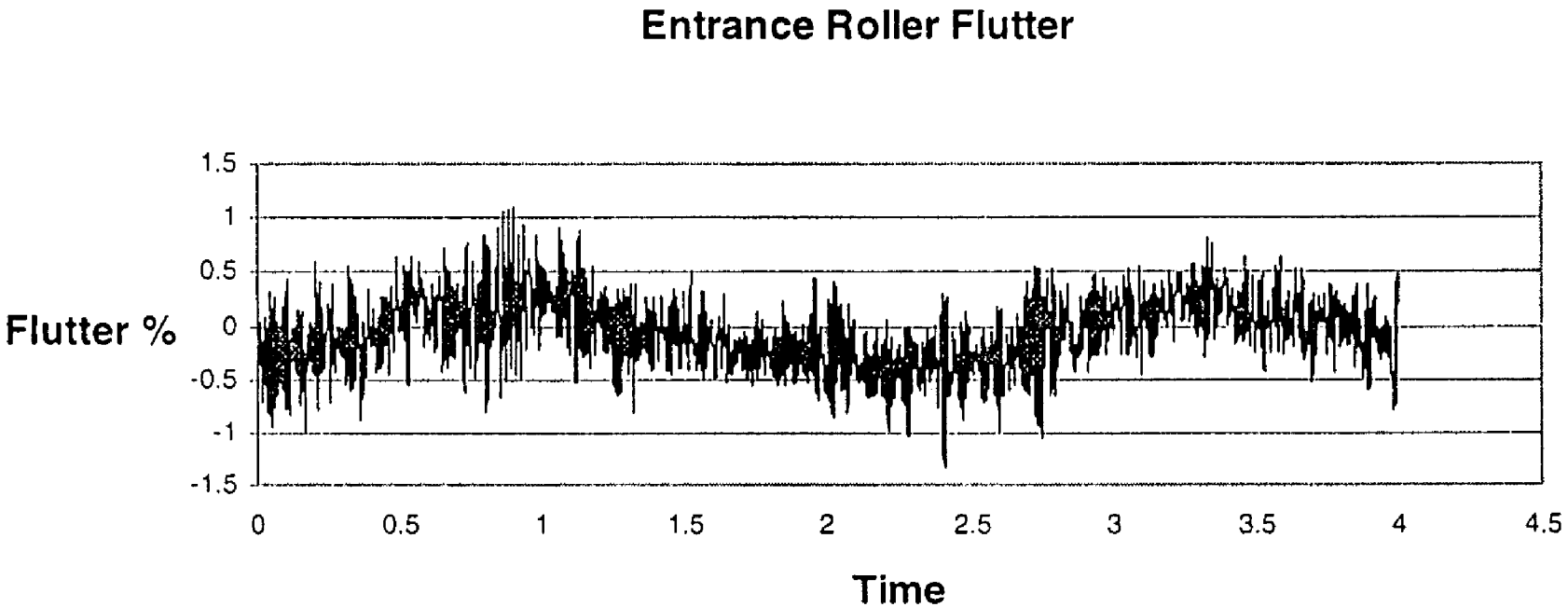
FIGS. 10A and 10B are graphs showing comparative flutter levels over time for different embodiments of the present invention.

Referring to FIG. 10A, there is shown a time domain measurement of flutter for dual nip transport apparatus 30 as shown in FIG. 3, in which coupling roller 36 is used, without an auxiliary belt 66 or counter roller 68 to provide an opposing force as was shown with reference to FIGS. 8, or 9A and 9B. Flutter is best measured when taken across the coupling. Thus, when motor 60 drives exit drive roller 26, flutter is best measured at entrance drive roller 16. As the graph of FIG. 10A shows, peak-to-peak flutter measured at entrance drive roller 16 exceeds 2% with this configuration.

Figure 10B:
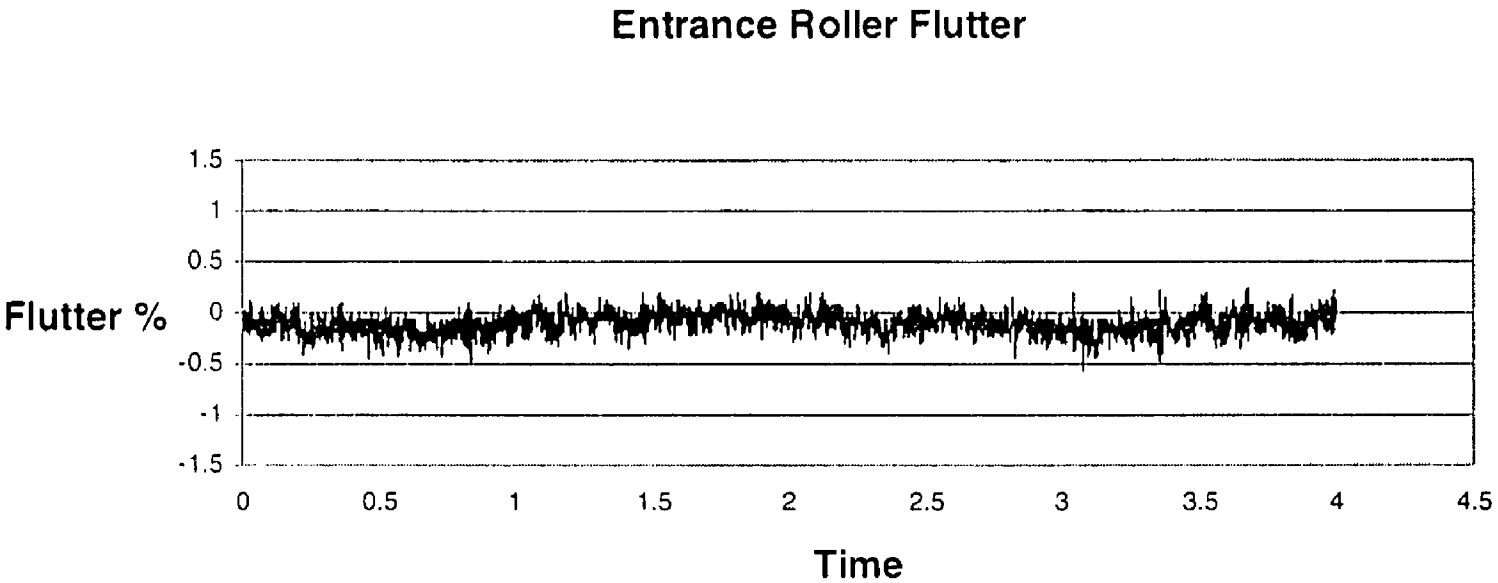

Referring to FIG. 10B, there is shown the corresponding time domain flutter measurement for coupling apparatus 54 as shown in FIG. 3B, in which coupling roller 36 cooperates with counter roller 68. As can be seen by comparison with FIG. 10A, the opposing force provided by counter roller 68 reduces flutter to below about 0.6% peak-to-peak.

Figure 11A:
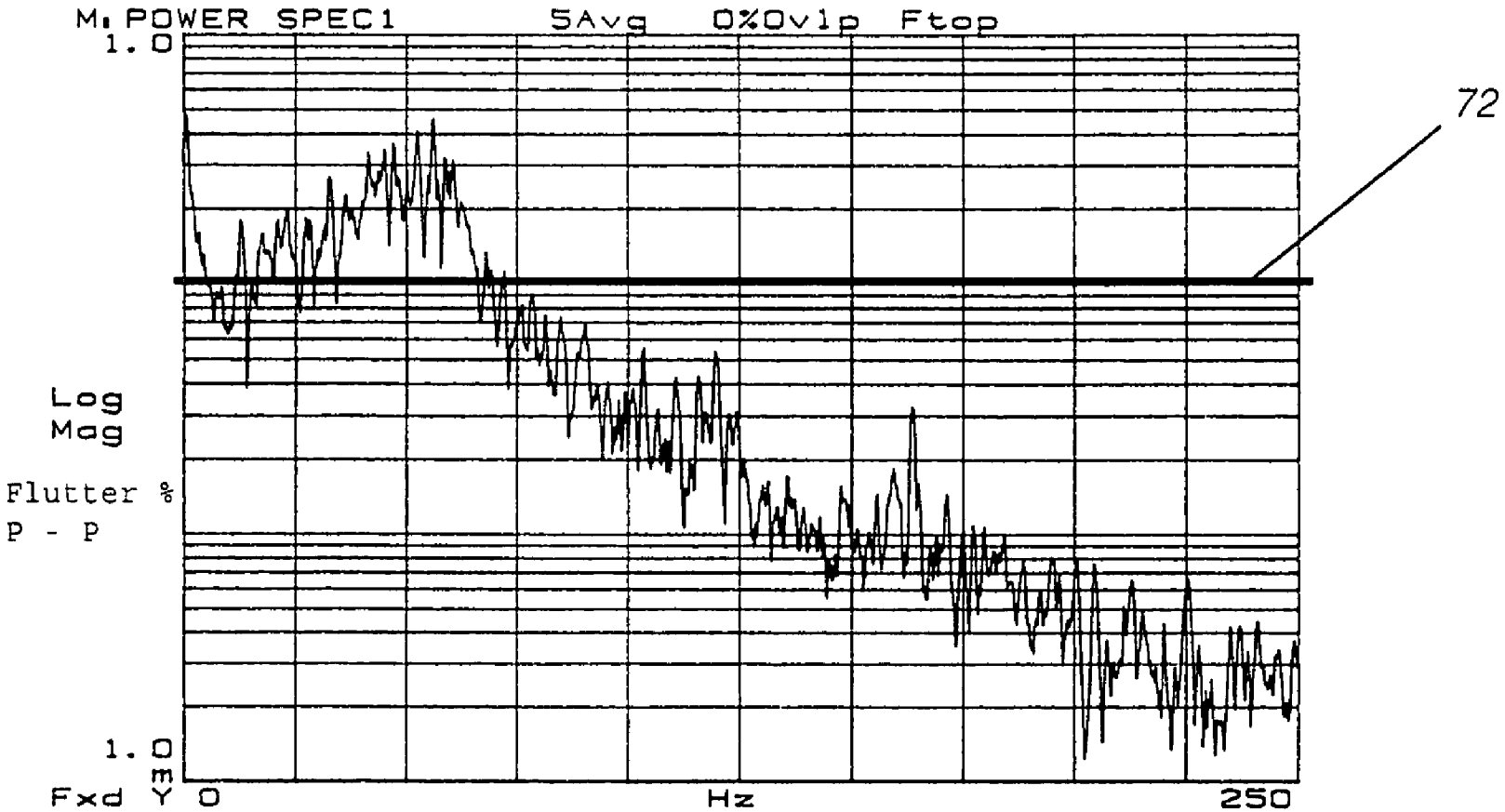
FIGS. 11A and 11B are graphs showing comparative flutter levels from a frequency perspective for different embodiments of the present invention.
Figure 11B:
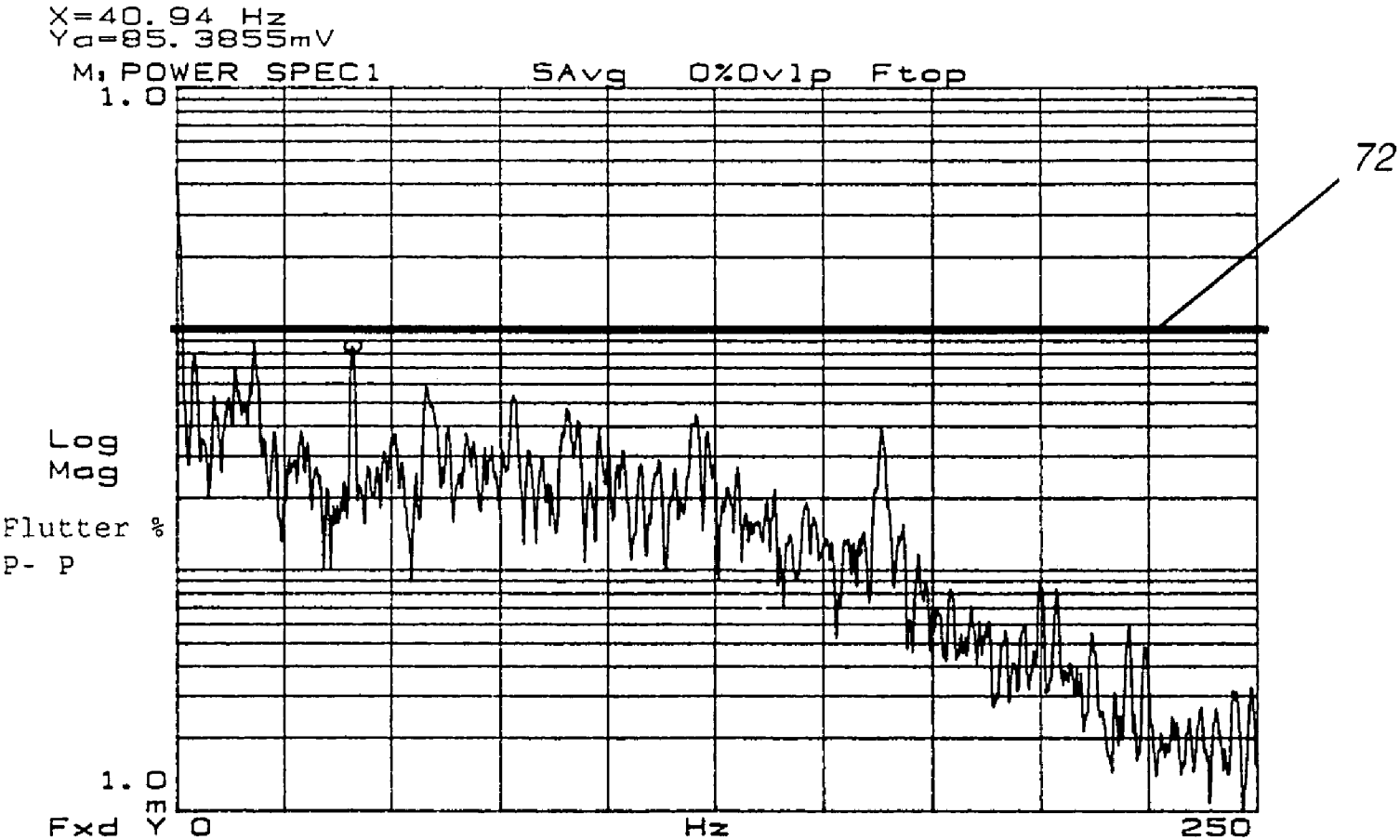

Referring to FIG. 11A, there is shown a frequency domain distribution of flutter magnitude for the hardware configuration corresponding to that used for FIG. 10A (no belt 66, no counter roller 68). A reference magnitude level is indicated by a bold horizontal line 72. Similarly, the graph of FIG. 11B shows the frequency domain distribution corresponding to that used for FIG. 10B (with counter roller 68.) By comparison, the flutter error has been dramatically reduced by providing counter roller 68 for added coupling stiffness.

Figure 1:
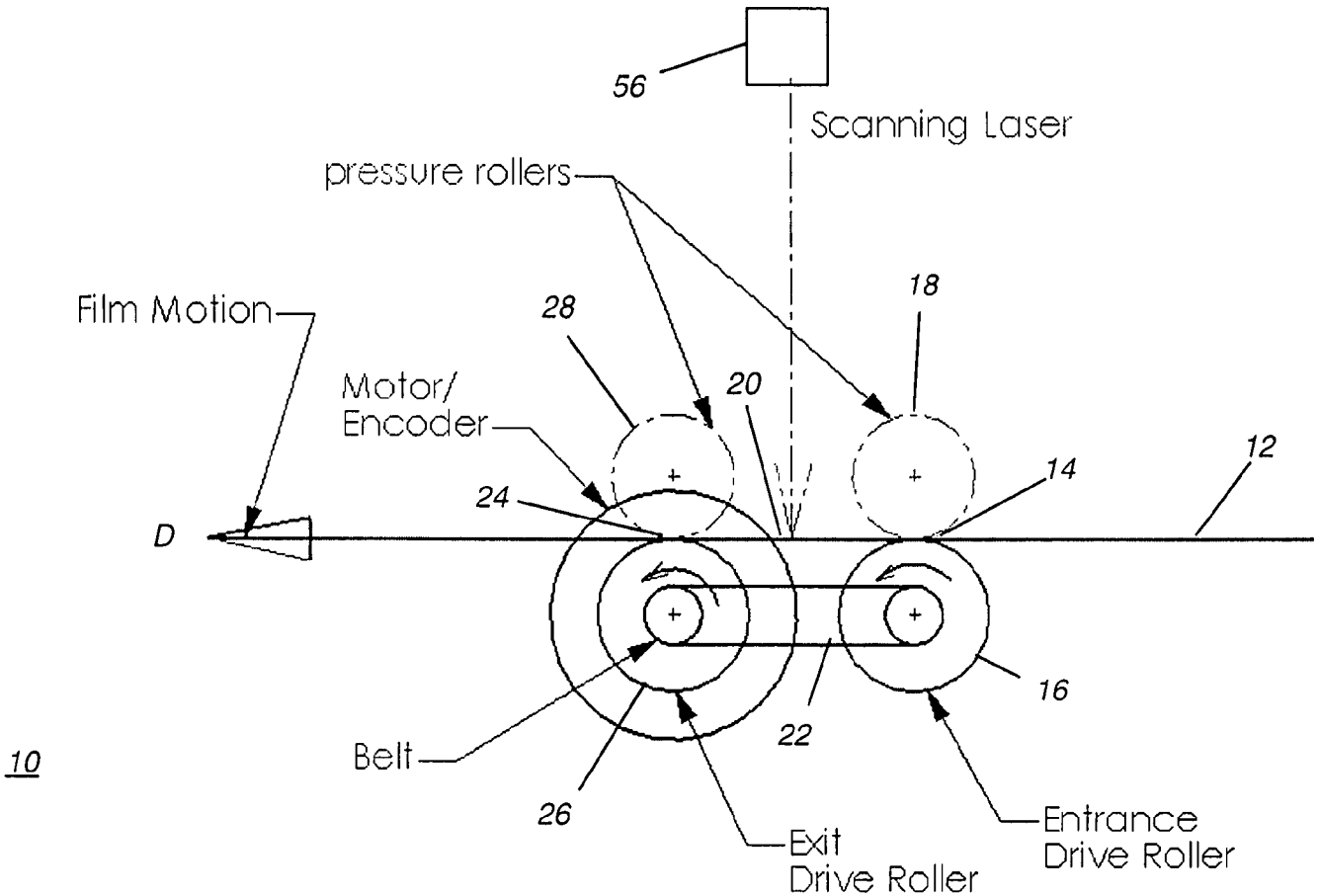
FIG. 1 PRIOR ART
FIG. 1 is a schematic diagram showing a conventional dual-nip media transport apparatus.

The use of coupling roller 36 according to the present invention is particularly advantaged for use in image recording apparatus 58 (FIG. 2) because it couples the surface velocities of entrance drive roller 16 and exit drive roller 26. This is unlike conventional coupling using belt mechanisms, as was shown in FIG. 1. In most conventional devices, belt 22 typically couples rollers over a surface having a different radius than the surface that contacts sheet recording medium 12. Moreover, belt 22 must be disposed at one end or the other of drive rollers 16 and 26, so that the coupling force is not distributed equally along the length of the coupled rollers. Overall, coupling roller 36 provides a coupling force that is not only more uniformly distributed along the length of drive and exit rollers 16 and 26, but provides enhanced coupling stiffness over its belt 22 counterpart. Very stiff belts, such as stainless steel belts, could be used, but exhibit other problems, such as relatively poor tracking, that compromise their effectiveness in this type of application.

Dual nip transport apparatus 30 of the present invention is particularly effective for providing controlled motion of sheet medium 12 in image recording apparatus 58 that images onto the full sheet of medium 12, from leading edge 32 to trailing edge 34 (FIG. 2). By using coupling roller 36, transport apparatus 30 provides precision linear movement of sheet medium 12 whether medium 12 is gripped in both or only in one of entrance and exit nips 14 and 24.

While the use of coupling roller 36 helps to reduce flutter to low levels, the addition of belt 66 or counter roller 68 has been shown to contribute further to flutter reduction when working in cooperation with coupling roller 36. The overall high level of coupling stiffness provided by coupling roller 36 and belt 66 or counter roller 68 advantageously increases the mechanical resonance frequency of dual nip transport apparatus 30.

The invention has been described in detail with particular reference to certain preferred embodiments thereof, but it will be understood that variations and modifications can be effected within the scope of the invention as described above, and as noted in the appended claims, by a person of ordinary skill in the art without departing from the scope of the invention. For example, rollers used within dual nip transport apparatus 30 could be formed from a number of materials, suitably selected according to roller function. In one embodiment, for example, drive rollers 16 and 26 are urethane-coated rollers. A combination of spring force and magnetic or electromagnetic attraction could be used to nest coupling roller 36 into position. Multiple coupling rollers 36 or counter rollers 68 could be used, as well as a roller mechanism that is sectioned into a number of smaller rollers. One or more of coupling rollers 36 or counter rollers 68 could be hollow, particularly where magnetic attraction is used for nesting.

Various types of printhead 56 could be employed, such as using lasers, LEDs, or other light sources, wherein the light emitted may be outside the visible spectrum. Other types of printhead, utilizing thermal or inkjet printing mechanisms, could be used. Sheet medium 12 could be a photosensitive medium or some other type of recording medium. Either entrance drive roller 16 or exit drive roller 26 could serve as the driving roller in an embodiment. Alternately, coupling roller 36 could itself be directly coupled to motor 60 to serve as a driving roller.

Thus, what is provided is an apparatus and method for an image recording apparatus with a precision media transport apparatus that uses a dual nip system having precision drive roller motion coupled by a coupling roller.

PARTS LIST

10 dual nip transport apparatus
12 recording medium
14 entrance nip
16 entrance drive roller
18 pressure roller
20 imaging area
22 belt
24 exit nip
26 exit drive roller
28 pressure roller
30 dual nip transport apparatus
32 leading edge
34 trailing edge
36 coupling roller
38 core
40 shell
42 bearing
44 spring mount
46 spring

48 shaft
50 magnets
52 bar
54 coupling apparatus
56 printhead
58 image recording apparatus
60 motor
62 control logic processor
64 surface interface
66 belt
68 counter roller
70 surface interface
72 line
74 post
76 magnet

The invention claimed is:

1. An apparatus for recording an image on a sheet medium, comprising:

a) an entrance drive roller paired with a corresponding entrance pressure roller to form an entrance nip for transporting the sheet medium into an image recording section;

b) an image recording section comprising a write head for recording on a portion of the sheet medium being transported between the entrance nip and an exit nip;

c) the exit nip formed by an exit drive roller paired with a corresponding exit pressure roller, for transporting the sheet medium out of the image recording section;

d) a motor for providing rotary motion;

e) a coupling apparatus for coupling rotary motion between the exit drive roller and the entrance drive roller, the coupling apparatus comprising:

i) a coupling roller elongated in a width dimension of the sheet medium;

ii) a loading mechanism providing a loading force to nest the coupling roller into continuous rotational contact against the entrance and exit drive rollers;

whereby rotation is transferred between the exit drive roller and the entrance drive roller by the coupling roller; and wherein the coupling apparatus further comprises a counter roller coupling the exit drive roller with the entrance drive roller.

2. An apparatus according to claim 1 wherein the motor drives the entrance drive roller.

3. An apparatus according to claim 1 wherein the motor drives the exit drive roller.

4. An apparatus according to claim 1 wherein the loading force provided by the loading mechanism is magnetic.

5. An apparatus according to claim 1 wherein the loading force provided by the loading mechanism is spring force.

6. An apparatus according to claim 1 wherein the loading mechanism comprises an electromagnet.

7. An apparatus according to claim 1 wherein the write head comprises a light source.

8. An apparatus according to claim 1 wherein the write head comprises a laser.

9. An apparatus according to claim 1 wherein the coupling apparatus further comprises a belt coupling the exit drive roller with the entrance drive roller.

10. An apparatus according to claim 1 wherein the counter roller is subject to a magnetic loading force.

11. An apparatus according to claim 10 wherein the magnetic force is provided by a permanent magnet.

12. An apparatus according to claim 1 wherein the counter roller is subject to an electromagnetic loading force.

13. An apparatus according to claim 1 wherein the counter roller is subject to a spring loading force.

14. An apparatus according to claim 1 wherein the counter roller is hollow.

15. An apparatus according to claim 1 wherein the coupling roller is hollow.

16. An apparatus according to claim 1 wherein the counter roller comprises a plurality of individual roller sections.

17. An apparatus according to claim 1 wherein the coupling roller comprises a plurality of individual roller sections.

18. An apparatus for recording an image onto a sheet medium, comprising:

a) an entrance drive roller paired with a corresponding entrance pressure roller to form an entrance nip for transporting the sheet medium into an image recording section;

b) the image recording section comprising a write head for recording onto a portion of the sheet medium being transported between the entrance nip and an exit nip;

c) the exit nip formed by a drive roller paired with a corresponding exit pressure roller, for transporting the sheet medium out from the image recording section;

d) a motor for rotating the exit drive roller;

e) a coupling apparatus for coupling rotary motion between the exit drive roller and the entrance drive roller, the coupling apparatus comprising:

i) a coupling roller elongated in the width dimension of the sheet medium;

ii) a loading mechanism providing a loading force to nest the coupling roller into continuous rotational contact against the entrance and exit drive rollers;

whereby rotation is transferred between the exit drive roller and the entrance drive roller by the coupling roller; and wherein the coupling apparatus further comprises a counter roller coupling the exit drive roller with the entrance drive roller.

19. An apparatus according to claim 18 wherein the loading force provided by the loading mechanism is magnetic.

20. An apparatus according to claim 18 wherein the loading force provided by the loading mechanism is spring force.

21. An apparatus according to claim 18 wherein the loading mechanism comprises an electromagnet.

22. An apparatus according to claim 18 wherein the write head comprises a light source.

23. An apparatus according to claim 18 wherein the write head comprises a laser.

24. An apparatus according to claim 18 wherein the coupling apparatus further comprises a belt coupling the exit drive roller with the entrance drive roller.

25. An apparatus according to claim 18 wherein the counter roller is subject to a magnetic loading force.

26. An apparatus according to claim 18 wherein the coupling roller is subject to an electromagnetic loading force.

27. An apparatus according to claim 18 wherein the counter roller is subject to an electromagnetic loading force.

28. An apparatus according to claim 18 wherein the counter roller is subject to a spring loading force.

29. An apparatus according to claim 18 wherein the counter roller is hollow.

30. An apparatus according to claim 18 wherein the coupling roller is hollow.

31. An apparatus according to claim 18 wherein the counter roller comprises a plurality of individual roller sections.

32. An apparatus according to claim 18 wherein the coupling roller comprises a plurality of individual roller sections.

33. An apparatus according to claim 18 wherein the loading force is provided by a permanent magnet.

34. An apparatus for recording an image onto a sheet medium, comprising:

a) an entrance drive roller paired with a corresponding entrance pressure roller to form an entrance nip for transporting the sheet medium into an image recording section;

b) the image recording section comprising a write head for recording onto a portion of the sheet medium being transported between the entrance nip and an exit nip;

c) the exit nip formed by a drive roller paired with a corresponding exit pressure roller, for transporting the sheet medium out from the image recording section;

d) a coupling apparatus for coupling rotary motion to the exit drive roller and the entrance drive roller, the coupling apparatus comprising:

i) a coupling roller elongated in the width dimension of the sheet medium;

ii) a motor for driving the coupling roller;

iii) a loading mechanism providing a loading force to nest the coupling roller into continuous rotational contact against the entrance and exit drive rollers; and wherein the coupling apparatus further comprises a counter roller coupling the exit drive roller with the entrance drive roller.

35. An apparatus according to claim 34 wherein the loading force provided by the loading mechanism is magnetic.

36. An apparatus according to claim 34 wherein the loading force provided by the loading mechanism is spring force.

37. An apparatus according to claim 34 wherein the loading mechanism comprises an electromagnet.

38. An apparatus according to claim 34 wherein the write head comprises a light source.

39. An apparatus according to claim 34 wherein the write head comprises a laser.

40. An apparatus according to claim 34 wherein the coupling apparatus further comprises a belt coupling the exit drive roller with the entrance drive roller.

41. An apparatus according to claim 34 wherein the counter roller is subject to a magnetic loading force.

42. An apparatus according to claim 34 wherein the counter roller is subject to an electromagnetic loading force.

43. An apparatus according to claim 34 wherein the coupling roller is subject to an electromagnetic loading force.

44. An apparatus according to claim 34 wherein the counter roller is subject to a spring loading force.

45. An apparatus according to claim 34 wherein the counter roller is hollow.

46. An apparatus according to claim 34 wherein the coupling roller is hollow.

47. An apparatus according to claim 34 wherein the counter roller comprises a plurality of individual roller sections.

48. An apparatus according to claim 34 wherein the coupling roller comprises a plurality of individual roller sections.

49. An apparatus for recording an image onto a sheet medium, comprising:

a) a first drive roller paired with a corresponding first pressure roller to form a first nip for transporting the sheet medium;

b) a second drive roller paired with a corresponding second pressure roller to form a second nip for transporting the sheet medium;

c) an image recording section comprising a write head for recording onto a portion of the sheet medium being transported between the first and second nips;

d) a motor for rotating the first drive roller;

e) a coupling apparatus for coupling rotary motion between the first and second drive rollers, the coupling apparatus comprising:

i) a coupling roller elongated in the width dimension of the sheet medium;

ii) a loading mechanism providing a loading force to nest the coupling roller into continuous rotational contact against the first and second drive rollers;

whereby rotation is transferred between the first and second drive rollers by the coupling roller; and wherein the coupling apparatus further comprises a counter roller coupling the exit drive roller with the entrance drive roller.

50. An apparatus according to claim 49 wherein the first drive roller is an entrance drive roller.

51. An apparatus according to claim 49 wherein the first drive roller is an exit drive roller.

52. A method for image recording onto a sheet medium comprising:

a) transporting the sheet medium into an image recording section through an entrance nip formed by pairing an entrance drive roller with a corresponding entrance pressure roller;

b) recording the image onto a portion of the sheet medium being transported between the entrance nip and an exit nip;

c) transporting the sheet medium out from the image recording section through the exit nip formed by pairing a drive roller with a corresponding exit pressure roller;

d) rotating either the entrance drive roller or the exit drive roller from a motor;

e) coupling rotary motion between the exit drive roller and the entrance drive roller by nesting a coupling roller into continuous rotational contact against the entrance and exit drive rollers, the coupling roller elongated in the width dimension of the sheet medium;

transferring rotation between the exit drive roller and the entrance drive roller by the coupling roller thereby; and nesting a counter roller into contact with a portion of the surface of the entrance drive roller and a portion of the surface of the exit drive roller, providing additional coupling stiffness thereby.

53. The method of claim 52 wherein the step of nesting a coupling roller comprises the step of applying a magnetic force.

54. The method of claim 52 wherein the step of nesting a counter roller comprises the step of applying a magnetic force.

* * * * *